US011414234B1

(12) United States Patent
Massey

(10) Patent No.: US 11,414,234 B1
(45) Date of Patent: Aug. 16, 2022

(54) SUSTAINABLE SHIPPING BOX, SYSTEM, AND METHODS

(71) Applicant: John Michael Massey, Denver, CO (US)

(72) Inventor: John Michael Massey, Denver, CO (US)

( * ) Notice: Subject to any disclaimer, the term of this patent is extended or adjusted under 35 U.S.C. 154(b) by 0 days.

(21) Appl. No.: 17/588,301

(22) Filed: Jan. 30, 2022

Related U.S. Application Data

(60) Provisional application No. 63/146,663, filed on Feb. 7, 2021.

(51) Int. Cl.
*B65D 5/36* (2006.01)
*B65D 5/42* (2006.01)
*B65D 5/04* (2006.01)

(52) U.S. Cl.
CPC ..... *B65D 5/3614* (2013.01); *B65D 5/04* (2013.01); *B65D 5/4266* (2013.01)

(58) Field of Classification Search
CPC ..... B65D 5/4266; B65D 5/04; B65D 5/3614; B65D 5/3678; B65D 21/086; B65D 5/3635; B65D 11/1833; B65D 5/02; B31B 2120/302; B31D 5/04
USPC ..... 229/198.2, 117.05, 117.01, 117.06; 493/409
See application file for complete search history.

(56) References Cited

U.S. PATENT DOCUMENTS 3,119,547 A 1/1964 Nute
4,349,110 A * 9/1982 Hayashi ..... B65D 5/542 229/207
5,062,527 A 11/1991 Westerman
5,460,324 A * 10/1995 Vinther ..... B65D 5/3664 229/405
5,762,262 A 6/1998 Martin
8,647,251 B2 * 2/2014 Kling ..... G06T 19/20 493/405
8,807,417 B2 * 8/2014 Valesini Gegembauer ..... B65D 5/20 D9/756
9,199,761 B2 12/2015 McDonald et al.
9,463,915 B2 10/2016 McDonald et al.
9,527,659 B2 12/2016 Fosbury et al.
10,279,981 B2 5/2019 Barias et al.
(Continued)

FOREIGN PATENT DOCUMENTS

CN 209127167 U 7/2019
DK 178719 B1 11/2016
(Continued)

*Primary Examiner* — Christopher R Demeree
(74) *Attorney, Agent, or Firm* — PK Patent Law

(57) ABSTRACT

A reusable shipping box system and methods are provided. The reusable shipping box system includes a shipping box including a rectangular sheet of material including a first planer surface and a second planer surface. The first planer surface can include a first herringbone pattern of half cut and full cut incisions and the second planer surface can include a second herringbone pattern which is different from the first herringbone pattern. The rectangular sheet of material can be capable of collapsing into an elongated shaped parcel by way of the first and second herringbone patterns of half cut and full cut incisions. A shipping sleeve can define a cross-sectional shape and sized to be capable of sliding over the collapsed shipping box and securely hold the shipping box in the collapsed shape.

22 Claims, 6 Drawing Sheets

(56) References Cited

U.S. PATENT DOCUMENTS

| | | | | |
|---|---|---|---|---|
| 10,392,156 | B2 | 8/2019 | McDonald et al. | |
| 10,745,187 | B1 * | 8/2020 | Vincent | B65D 81/3858 |
| 11,180,279 | B1 | 11/2021 | Semmelhack et al. | |
| 11,230,404 | B2 * | 1/2022 | Sollie | B65D 5/5415 |
| 11,319,133 | B2 * | 5/2022 | Kling | B65D 5/5054 |
| 2004/0031842 | A1 * | 2/2004 | Westerman | B65D 81/38 229/117.06 |
| 2005/0089675 | A1 * | 4/2005 | Christiansen | B32B 3/12 428/174 |
| 2005/0267616 | A1 * | 12/2005 | Kling | G06T 17/20 700/98 |
| 2017/0320615 | A1 * | 11/2017 | Izquierdo | B65D 5/448 |

FOREIGN PATENT DOCUMENTS

| | | | |
|---|---|---|---|
| GB | 2235921 | A | 3/1991 |
| JP | 2002-128070 | A | 5/2002 |
| JP | 2010-13169 | A | 1/2010 |
| WO | 2014198800 | A2 | 12/2014 |

* cited by examiner

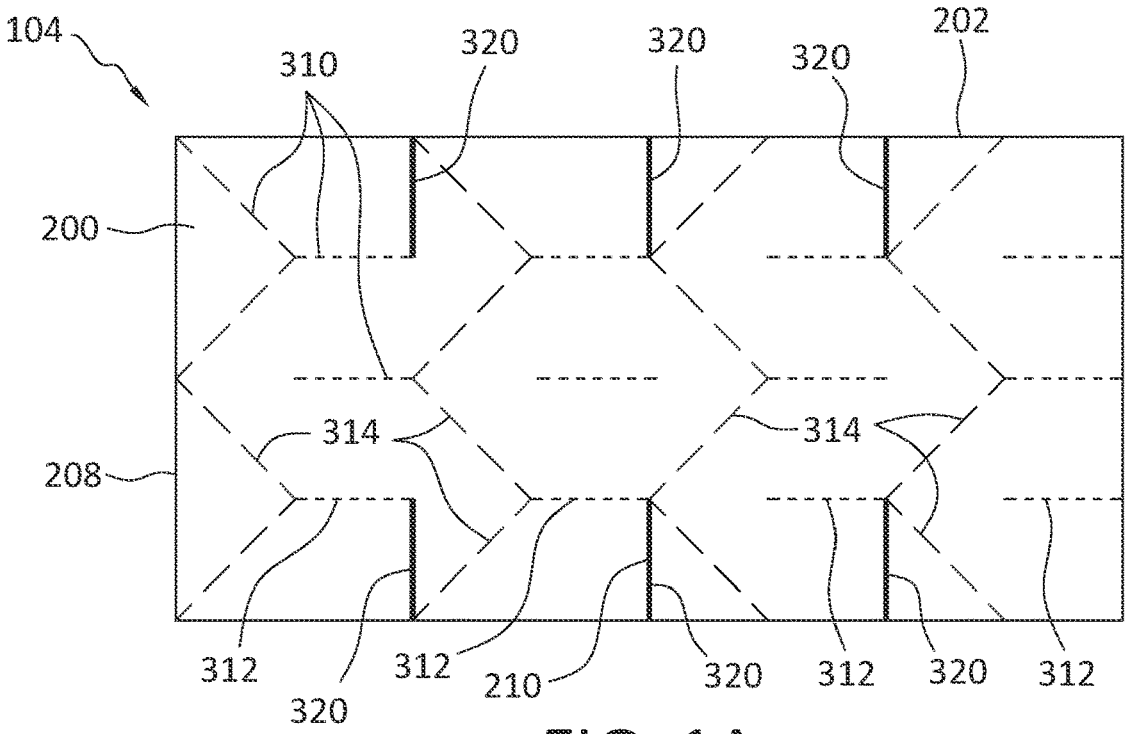
FIG. 1A
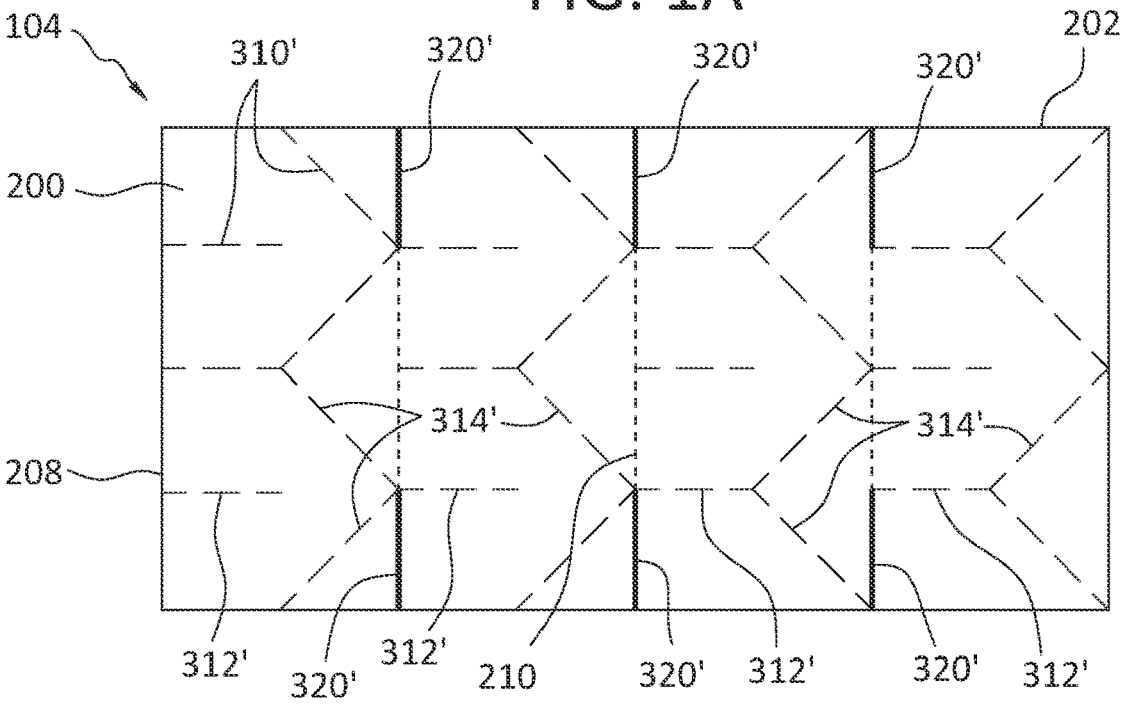
FIG. 1B
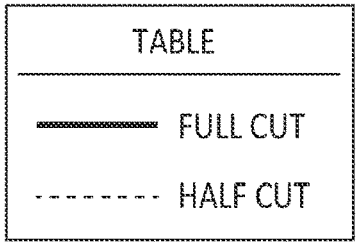

| OZ | BOX Form Inches | | | MAIL Form Inches | | |
|---|---|---|---|---|---|---|
| Box Weight | Width | Length | Height | Length | Width (includes sleeve) | Height |
| 2 | 2.5 | 2.5 | 2.5 | 4 | 0.5 | 1 |
| 4 | 5 | 5 | 5 | 8 | 1 | 2 |
| 8 | 10 | 10 | 10 | 17 | 2 | 4 |
| 12 | 10 | 25 | 15 | 17 | 5 | 6 |

SUSTAINABLE SHIPPING BOX, SYSTEM, AND METHODS

CROSS REFERENCE TO RELATED APPLICATION

The present application claims the benefit from earlier filed U.S. Provisional Patent Application Ser. No. 63/146,663, filed Feb. 7, 2021, which is incorporated herein in its entirety by reference.

FIELD OF THE INVENTION

The present teachings relate to a collapsible shipping box and system. In particular, the present teachings relate to a shipping box system that allows a residential parcel recipient to readily collapse a used shipping box and send it back to the shipper via their regular mail carrier using their residential mailbox.

BACKGROUND OF THE INVENTION

Most cardboard boxes used by businesses to ship products to consumers are designed for single-use and the consumer ends up disposing the box after its receipt in the garbage or in a recycling bin. This creates a nuisance to consumers who must dispose of the box and the extensive volume of single-use boxes has resulted in significant environmental damage. To reduce environmental impact, shipping boxes have been constructed more cheaply with a reduced durability. However, they still require disposal after use by the recipient.

There are known attempts to create a reusable shipping box but they suffer from many drawbacks. Known non-cardboard box-shaped solutions are considered durable but tend to be very heavy or too big in two or more dimensions to qualify for routine pick-up by a mail carrier. This is because they are designed to fold flat only in one dimension. Alternatively, it is known to use soft-sided pouches that can be returned by the consumer to the shipper empty (or with the return inside) for re-use. However, these pouches are limited to shipping small, generally flat, non-fragile products such as linens. Such known pouches also do not provide adequate protection from breakage for the returned product.

It is also important to note that there are physical sizing regulations for sending items through the U.S. Postal Service ("USPS") to avoid incurring special shipping charges. For example, residential mailboxes have size guidelines (i.e. maximum heights, widths, and depths) whereby only parcels that are capable of fitting inside qualify to be picked-up by mail carriers during their routine routes without incurring additional shipping costs. For another example, collection boxes (blue bins) have narrow openings that severely restrict the size of packages that can be dropped therein.

As a result, if a package is unable to fit within a standard residential mailbox or within the slot of a standard blue bin collection box, the residential sender is forced with either the inconvenience of taking the package to a local post office or is required to add additional postage and schedule a special pick-up. These inconveniences result in a higher likelihood that the original shipping container would not be reused and adversely impact the environmental.

Accordingly, there exists a need to replace single-use cardboard boxes with a durable and efficiently designed alternative shipping container and system that can be very easily returned by a consumer to a shipper via a mail carrier and reused.

SUMMARY OF THE INVENTION

The present teachings provide a reusable shipping box. The reusable shipping box can include a rectangular sheet of corrugated material including a first planer surface and a second planer surface. The first planer surface can include a first herringbone pattern of half cut and full cut incisions and the second planer surface can include a second herringbone pattern of half cut and full cut incisions which is different from the first herringbone pattern. The rectangular sheet can be capable of being folded in half to create a dual sheet unit. The dual sheet unit can be capable of collapsing into an elongated shaped parcel by way of the first and second herringbone patterns of half cut and full cut incisions.

The present teachings also provide a reusable shipping box system. The reusable shipping box system can include a shipping box including a rectangular sheet of corrugated material including a first planer surface and a second planer surface. The first planer surface can include a first herringbone pattern of half cut and full cut incisions and the second planer surface can include a second herringbone pattern of half cut and full cut incisions which is different from the first herringbone pattern. The shipping box can be capable of collapsing by way of the first and second herringbone patterns of half cut and full cut incisions into a collapsed shape of an elongated parcel. The reusable shipping box system can include a shipping sleeve defining a cross-sectional shape sized to be capable of sliding over the collapsed shipping box and can securely hold the shipping box in the collapsed shape.

The present teachings further provide a reusable shipping box system that can include a shipping box including a rectangular sheet of material including a first planer surface and a second planer surface. The first planer surface can include a first herringbone pattern of half cut and full cut incisions and the second planer surface can include a second herringbone pattern of half cut and full cut incisions which is different from the first herringbone pattern. The rectangular sheet of material can be capable of collapsing into an elongated shaped parcel by way of the first and second herringbone patterns of half cut and full cut incisions. The system can further include a shipping sleeve defining a cross-sectional shape sized to be capable of sliding over the collapsed shipping box and to securely hold the shipping box in the collapsed shape.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

BRIEF DESCRIPTION OF THE DRAWINGS

FIG. 1A shows a first herringbone pattern of half cut and full cut incisions formed on a first bottom surface of the planer material of a shipping box according to the present teachings;

FIG. 1B shows a second herringbone pattern of half cut and full cut incisions formed on a second surface of the planer material of the shipping box according to the present teachings;

Figure 2:
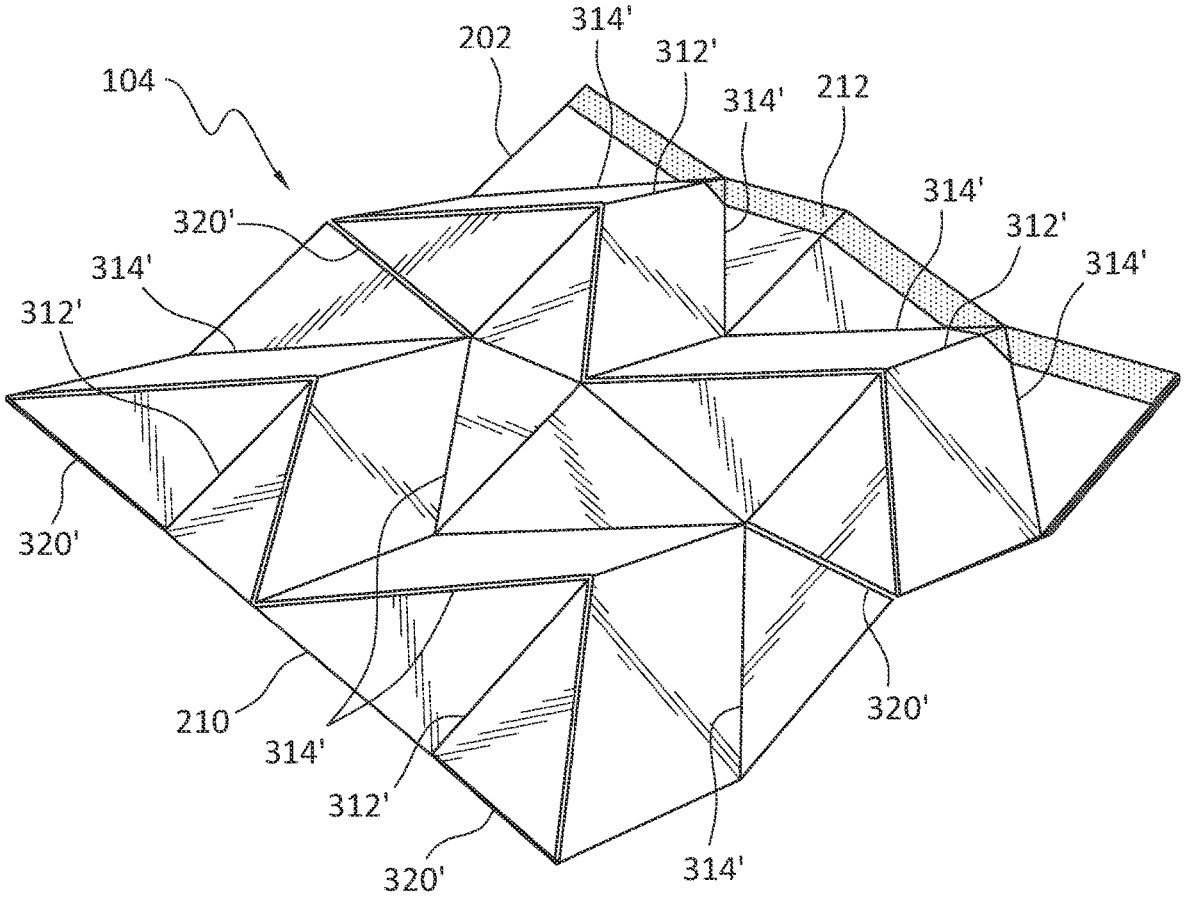
FIG. 2 shows the initial stage of collapsibility of the shipping box according to the present teachings.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings relate to a reusable shipping box system 100 that allows a shipping box to be constructed into a large-sized parcel and packed like a typical cardboard box and capable of collapsing into a relatively small-sized parcel for return to a shipper. When collapsed to a size capable of fitting within a residential mailbox, the parcel can be picked-up as part of a routine mail delivery. A routine pickup prevents the scheduling of a special pickup and incurring special shipping charges, encourages an easy return process, and reduces boxing costs for shippers, fulfillment centers, and the like. The reusable shipping box system 100 of the present teachings is driven by the need to provide consumers with a very convenient way to return reusable boxes, the reduction of environmental impact, and cost savings for shippers.

FIGS. 1A and 1B show a bottom view and a top view, respectively, of a substantially planer material sheet 200 that can form the shipping box 104 of the system 100 according to an embodiment of the present teachings. In this exemplary embodiment, the planer sheet 200 making up the shipping box 104 includes a long side 202 that can be about twice the length of a short side 208. This length-to-width ratio is capable of ultimately forming a cube-shaped shipping parcel or box as will be described in more detail below. However, the substantially planer material sheet 200 making up the shipping box 104 of the present teachings can be cut to any size (i.e. any rectangular length and width) depending on the desired packaging needs of the shipper.

The planer sheet 200 can be made of any durable material, such as a corrugated or fluted polypropylene sheeting. As shown in each of FIGS. 1A and 1B, each side or surface of the planer sheet 200 can include a unique and carefully arranged herringbone pattern of half cut incisions 310, 310' and full cut incisions 320, 320'. The use of two-walled corrugated material along with the carefully traced herringbone patterns of half cut incisions and full cut incisions allow the creation of releases that allow the shipping box 104 to collapse (not fold) onto itself when light pressure is applied. The herringbone patterns of half cut and full cut incisions allow the planer sheet 200 to form a strong box for shipping items to a consumer and to later readily mechanically collapse into a small size parcel for shipment back to the shipper for reuse.

Figure 8:
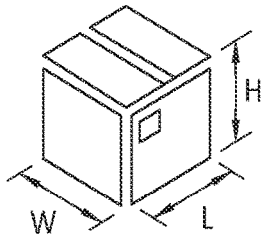
FIG. 8 is a table of various sized shipping boxes of the reusable shipping box system of the present teachings along with dimensions in box form and in a collapsed mail form.
Figure 8:
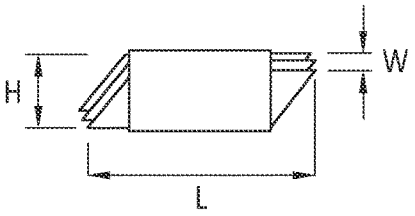

For example, if the longer side 202 of the shipping box 104 is about 40 inches long and the shorter side is about 20 inches long, the herringbone patterns of half cut and full cut incisions as exactly shown in FIGS. 1A and 1B would be capable of being constructed into a 10 inch by 10 inch by 10 inch cube-shaped shipping parcel. These dimensions correspond to the 8 ounce box size as shown in the table of FIG. 8 that will be discussed in more detail below.

Referring to each of FIGS. 1A and 1B, the herringbone patterns of half cut incisions and full cut incisions can include several series of linearly aligned half cut incisions 312, 312'. The herringbone patterns can also include angled half cut incisions 314, 314' that are angled with respect to the linearly aligned half cut incisions 312, 312'. For example, the linearly aligned half cut incisions 312, 312' and the angled half cut incisions 314, 314' can form an angle of about 135 degrees. The angle formed between these aligned half cut incisions 312, 312' and angled half cut incisions 314, 314' can vary depending on the desired size of the shipping box. The angled half cut incisions 314, 314' can also be arranged to be angled with respect to the substantially perpendicularly arranged full cut incisions 320, 320'.

Furthermore, the herringbone patterns of half cut incisions and full cut incisions can include aligned half cut incisions 312, 312' that can be arranged substantially perpendicularly with respect to the full cut incisions 320, 320'. The angled half cut incisions 314, 314' can also be arranged to be angled with respect to the full cut incisions 320, 320'. For example, the angled half cut incisions 314, 314' and the full cut incisions 320, 320' can form an angle of about 45 degrees. The angle formed between these half cut incisions 314, 314' and substantially perpendicularly arranged full cut incisions 320, 320' can vary depending on the desired size of the shipping box.

In an initial state of the shipping box 104, before it is formed into a box by a fulfillment center worker, the planer sheet 200 of FIGS. 1A and 1B is folded along a crease line 210 created by the shown herringbone patterns of incisions. Moreover, the respective ends of the short sides 208 of the planer sheet can be secured to one another by way of a joint 212, see FIG. 2. The joint 212 can be secured together using any connection method, such as by way of a manufactured joint.

Accordingly, when a shipper, such as fulfillment center worker, initially grabs a shipping box 104 of the present teachings it is a substantially planer dual sheet unit that can be readily constructed into a box shape for packing one or more items to be shipped. Upon receipt by the consumer, the shipping box 104 is emptied and is then capable of being readily de-constructed back to a substantially planer, dual layer unit. Then, as shown in FIGS. 2 and 3, with light pressure being applied on the substantially flat shipping box 104, it can be readily collapsed into a small, elongated shape.

Figure 3:
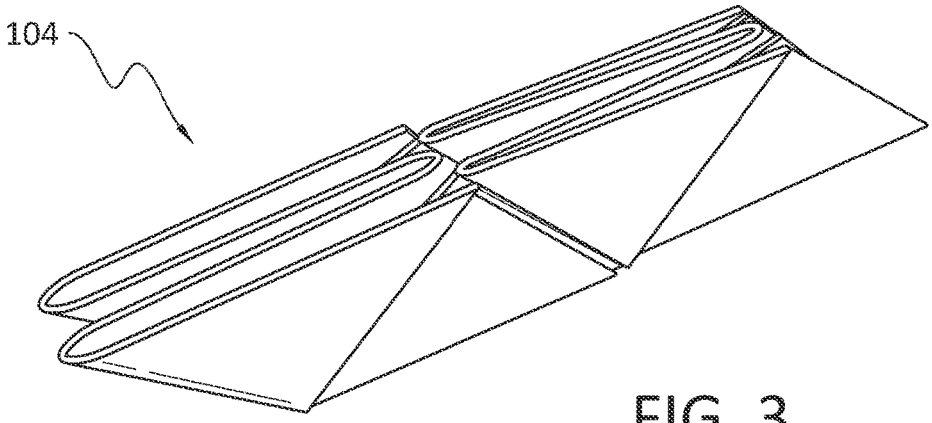
FIG. 3 shows the fully collapsed shipping box of FIG. 2 according to the present teachings.

FIG. 2 shows the beginning of the collapsing stage of the shipping box 104 facilitated by the herringbone patterns of half cut and full cut incisions of the present teachings on the corrugated or fluted material sheet. The herringbone patterns of incisions in the corrugated material promote the mechanical collapse of the shipping box 104 in an origami-like manner by the application of light pressure so that the shipping box 104 can ultimately form an elongated rectangular shape, such as, for example, a parallelogram, as shown in FIG. 3.

Figure 4:
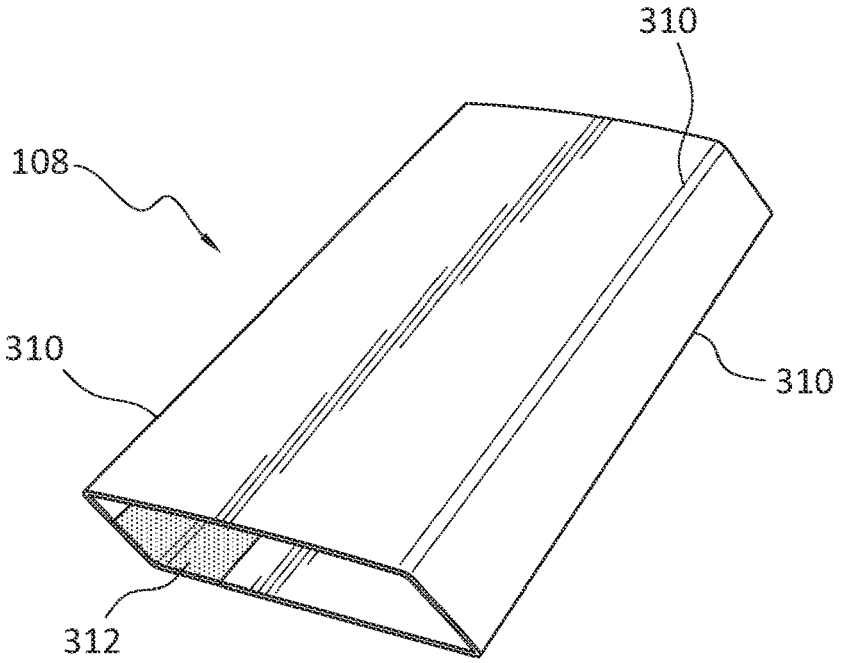
FIG. 4 shows a perspective view of the shipping sleeve of the reusable shipping box system 100 of the present teachings.
Figure 5:
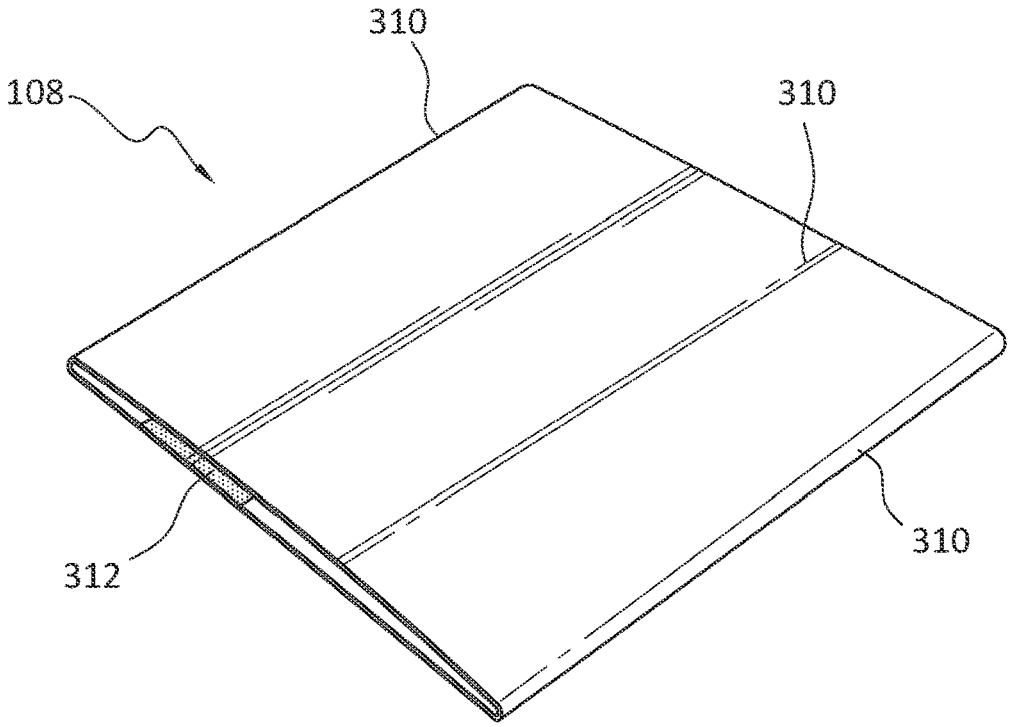
FIG. 5 shows a perspective view of the shipping sleeve of FIG. 4 in a folded flat position.

Referring now to FIGS. 4 and 5, the reusable shipping box system 100 can further include a shipping sleeve 108. The shipping sleeve 108 can be made from the same or similar durable corrugated material that makes up the shipping box 104. The shipping sleeve 108 can be formed from a single planer sheet of corrugated polypropylene material and can include a series of crease lines 310 to form the sleeve. The ends of the sleeve material can be secured together using any connection method, such as by way of a manufactured joint 312. The folds 310 and joint 312 allow the shipping sleeve 108 to flex between a folded flat position (FIG. 5) and a fully open position (FIG. 4). In the fully open position, the shipping sleeve 108 possesses a substantially square or substantially rectangular cross-section. According to various embodiments, the shipping sleeve can be formed as an elongated box with closeable ends that fully encompasses the collapsed shipping box 104 for shipment back to the shipper.

Figure 6:
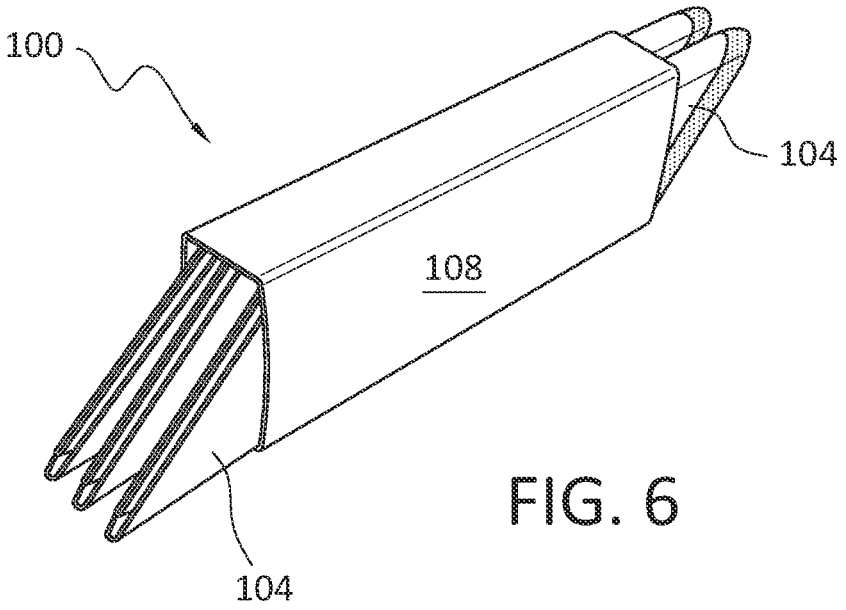
FIG. 6 shows a perspective view of the fully collapsed shipping box of FIG. 3 with the shipping sleeve arranged thereon and ready for shipping.

As shown in FIG. 6, in the fully collapsed state of the shipping box 104, the provided shipping sleeve 108 can be slid over the collapsed shipping box 104 in a manner to securely hold it in its collapsed state. The shipping sleeve 108 can be sized and shaped to hold the collapsed shipping box 104 by way of a friction fit that is strong enough to withstand typical shipping forces without sliding off of the shipping box 104.

Figure 7:
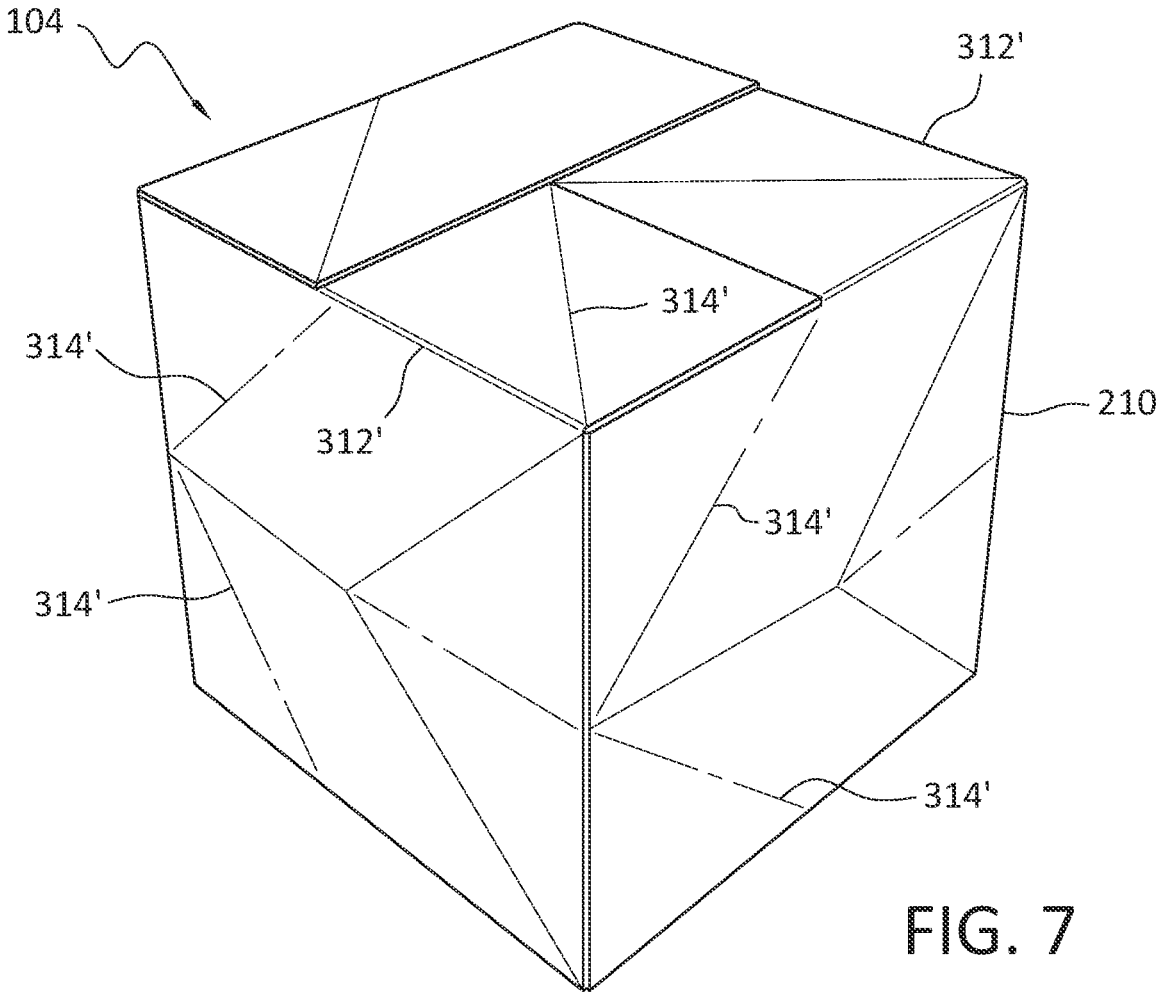
FIG. 7 shows the shipping box according to the present teachings constructed as a large shipping parcel.

The shipping box 104 and sleeve 108 make up the reusable shipping box system 100 of the present teachings. The herringbone patterns of half cut and full cut incisions allows the shipper to easily construct the shipping box 104 to create a large and strong parcel or package box for safely shipping their product to a consumer, see FIG. 7. After receipt of the product by the consumer, the herringbone patterns of half cut and full cut incisions on either side of the shipping box 104 then allows the consumer to efficiently collapse the shipping box 104 into a very small, elongated parcel. The shipping sleeve 104 can be sent to the consumer inside the fully formed package box along with the items being shipped. The shipping sleeve 104 can carry a prepaid return label for covering the costs of the return process.

With the shipping sleeve 108 securely wrapped around the collapsed box 104, the shipping box system 100 of the present teachings forms a parcel ready for shipping. If this parcel is capable of fitting within a standard-sized residential mailbox it can be picked up by the U.S. Postal Service as part of the customer's routine route preventing the need to schedule a special pickup or incur special postage charges. With a prepaid return label provided by the shipper on the shipping sleeve 108, the consumer can conveniently send the shipping box back to the fulfilment center by simply placing the parcel in their residential mailbox.

The substantially planer material sheet 200 that makes up the shipping box 104 can be made in a variety of sizes. For example, the length and width of the rectangular planer sheet 200 can be varied depending on the ultimate size of the desired parcel box. At the same time, the size and angling of the herringbone patterns of half cut and full cut incisions on either side of the planer sheet 200 can be altered depending on the dimensions thereof. In other words, each of the herringbone patterns can be correspondingly stretched or compressed depending on the sizing of the planer sheet 200. However, if it is desired to prevent incurring additional shipping charges, the top end sizing of the planer sheet 200 is limited by the ability of the collapsed box to fit within a standard-sized residential mailbox.

The table of FIG. 8 best illustrates the advantageous size reduction achieved by way of the reusable shipping box system 100 of the present teachings. In the table, four different box sizes (labeled as either "OZ" and "BOX Form Inches") are shown alongside their corresponding collapsed dimensions (labeled as "MAIL Form Inches"). While four different box sizes are shown in the table, the reusable shipping box system 100 of the present teachings is not limited to these sizes.

As the dimensions in the table of FIG. 8 show, the herringbone patterns of half cut and full cut incisions of the present teachings simultaneously allows i) the creation of a relatively large shipping box form, and ii) a collapsed generally elongated mail form which can be ideal for fitting into mailboxes and for reducing shipping costs. More particularly, the collapsibility of the shipping box 104 allows a resulting mail form (i.e. one that is elongated and thin) possessing two relatively small dimensions, i.e. the width and the height. This is in contrast to known packaging boxes which essentially only fold flat, which is a decrease in only one dimension. Based on how shipping costs are calculated by most mail carriers, minimizing the size of a parcel in two dimensions significantly reduces shipping costs and can allow the parcel to be picked up by a mail carrier during a routine pickup if capable of fitting into a residential mailbox.

Figure 9:
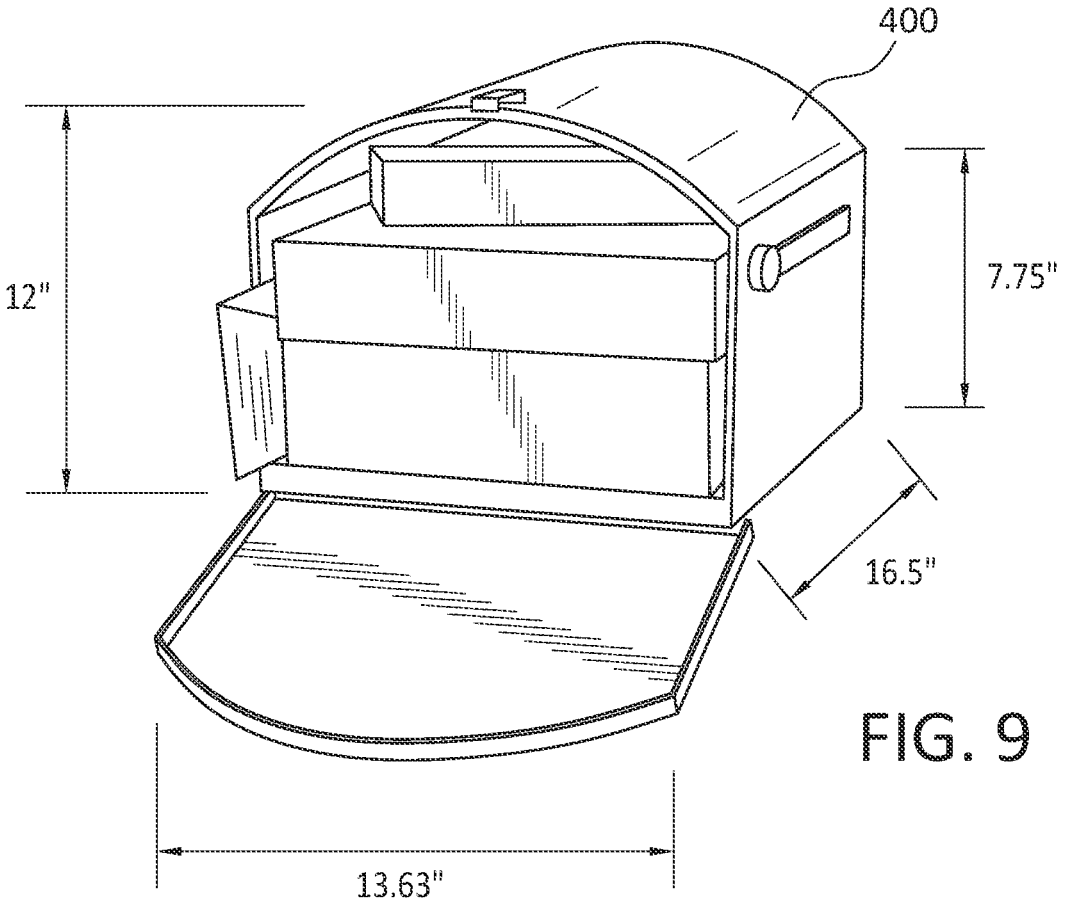
FIG. 9 shows the dimensions of a U.S. Postal Service next generation mailbox.
Figure 10:
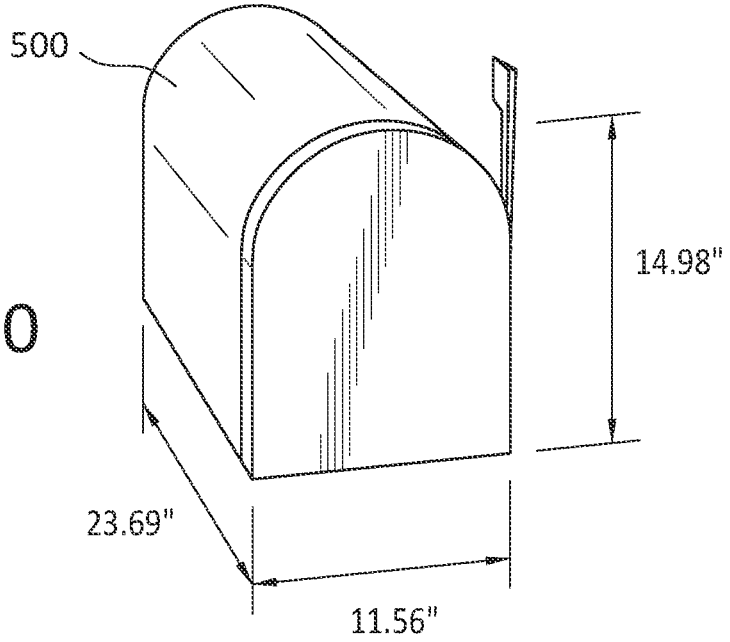
FIG. 10 shows the dimensions of a traditional "T3(C3)" residential mailbox mailbox.

FIGS. 9 and 10 shows the maximum dimensions for two U.S. Postal Service approved mailboxes for use at the curbside of a residence. FIG. 9 shows a next generation mailbox 400 that is newly designed to be package friendly in response to increase demand for online shopping. As illustrated, this new package friendly residential mailbox has a maximum width of about 13.63 inches, a maximum height of about 12 inches, and a maximum depth of about 16.5 inches.

FIG. 10 shows a large-sized version of a traditional "T3(C3)" residential mailbox 500. This "T3" residential mailbox has a maximum width of about 11.56 inches, a maximum height of about 14.98 inches, and a maximum depth of about 23.69 inches.

Accordingly, the resulting collapsed parcel having an elongated-shaped form is ideally suited to fit within a residential mailbox thereby allowing routine pickup by a U.S. Postal Mail carrier. More generally, the resulting collapsed elongated parcel formed by the reusable shipping box system 100 of the present teachings can result in significantly reduced return shipping costs.

The shipping box 104 and shipping sleeve 108 of the reusable shipping box system 100 can be made of a material that is durable to allow extended use. The material can be a non-porous and lightweight to keep shipping costs low, but sturdy enough to protect products being shipped in transit. The material also should not tear or be damaged when tape or labels are removed. In one embodiment, each surface of the box 100 may be made of polypropylene that is extruded into a corrugated sheet, then die cut or CNC cut. The material should have a high efficiency level of recycling so that at end of life, the box can be recycled down to its raw material and made available to make more of the reusable boxes without generating excessive waste and offering a comparatively lower carbon footprint than that of corrugated cardboard boxes. In a preferred embodiment, a commercially available product "Coroplast" can be used but there are a variety of alternatives available. More generally, the material used can be "corrugated plastic sheeting" or "fluted plastic sheeting". In other embodiments, any material that meets the specifications above could be used. For example, a non-limited list of possible alternative materials may include injection molded plastics, fabrics with woven structures, silicon with structural rigidity and/or nylons with structural rigidity.

According to various embodiments, the shipping box 104 and shipping sleeve 108 of the reusable shipping box system 100 can be reconfigured from the initial planer configuration to either of a shipping box configuration or collapsed parcel configuration without or a reduced amount of tape, glue and/or an adhesive that is ordinarily required for use of conventional cardboard shipping boxes. This allows fulfillment center workers to readily construct a large shipping box and consumers to readily collapse the shipping box into a small parcel. Every time the shipping box system 100 of the present teachings is reused, the community saves on energy and environmental damage associated with cardboard boxes.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A reusable shipping box comprising:

a rectangular sheet of corrugated material including a first planer surface and a second planer surface arranged on an opposite side of the shipping box to the first planer surface, the first planer surface including a first herringbone pattern of half cut and full cut incisions and the second planer surface including a second herringbone pattern of half cut and full cut incisions which is different from the first herringbone pattern;

wherein the rectangular sheet is capable of being folded in half to create a dual sheet unit; and wherein the dual sheet unit is capable of collapsing into an elongated shaped parcel by way of the first and second herringbone patterns of half cut and full cut incisions.

2. The reusable shipping box of claim 1, wherein the elongated parcel includes a parallelogram shape.

3. The reusable shipping box of claim 1, wherein the dual sheet of material is further capable of being constructed into a parcel box for shipping items therein.

4. The reusable shipping box of claim 1, wherein each of the first and second herringbone patterns include linearly aligned half cut incisions and half cut incisions angled with respect to the linearly aligned half cut incisions.

5. The reusable shipping box of claim 4, wherein the linearly aligned half cut incisions and the angled half cut incisions form an angle of about 135 degrees.

6. The reusable shipping box of claim 1, wherein each of the first and second herringbone patterns include linearly aligned half cut incisions and full cut incisions arranged substantially perpendicularly with respect to the linearly aligned half cut incisions.

7. The reusable shipping box of claim 6, wherein each of the first and second herringbone patterns include half cut incisions that are angled with respect to the substantially perpendicularly arranged full cut incisions.

8. The reusable shipping box of claim 7, wherein the angled half cut incisions form an angle of about 45 degrees with respect to the substantially perpendicularly arranged full cut incisions.

9. A reusable shipping box system comprising:

the reusable shipping box of claim 1; and a shipping sleeve defining a cross-sectional shape sized to be capable of sliding over the collapsed elongated shaped parcel and securely holding the shipping box in the collapsed shape.

10. A reusable shipping box system comprising:

a shipping box including a rectangular sheet of corrugated material including a first planer surface and a second planer surface arranged on an opposite side of the shipping box to the first planer surface, the first planer surface including a first herringbone pattern of half cut and full cut incisions and the second planer surface including a second herringbone pattern of half cut and full cut incisions which is different from the first herringbone pattern, the shipping box being capable of collapsing by way of the first and second herringbone patterns of half cut and full cut incisions into a collapsed shape of an elongated parcel; and a shipping sleeve defining a cross-sectional shape sized to be capable of sliding over the collapsed shipping box and securely hold the shipping box in the collapsed shape.

11. The reusable shipping box system of claim 10, wherein the elongated parcel includes a parallelogram shape.

12. The reusable shipping box system of claim 10, wherein the shipping box is capable of being constructed into a parcel box for shipping items therein.

13. The reusable shipping box system of claim 10, wherein each of the first and second herringbone patterns include linearly aligned half cut incisions and half cut incisions angled with respect to the linearly aligned half cut incisions.

14. The reusable shipping box system of claim 13, wherein the linearly aligned half cut incisions and the angled half cut incisions form an angle of about 135 degrees.

15. The reusable shipping box system of claim 10, wherein each of the first and second herringbone patterns include linearly aligned half cut incisions and full cut incisions arranged substantially perpendicularly with respect to the linearly aligned half cut incisions.

16. The reusable shipping box system of claim 15, wherein each of the first and second herringbone patterns include half cut incisions that are angled with respect to the substantially perpendicularly arranged full cut incisions.

17. The reusable shipping box of claim 16, wherein the angled half cut incisions form an angle of about 45 degrees with respect to the substantially perpendicularly arranged full cut incisions.

18. The reusable shipping box system of claim 10, wherein the rectangular sheet is capable of being folded to create a dual sheet.

19. A reusable shipping box system comprising:

a shipping box including a rectangular sheet of material including a first planer surface and a second planer surface arranged on an opposite side of the shipping box to the first planer surface, the first planer surface including a first herringbone pattern of half cut and full cut incisions and the second planer surface including a second herringbone pattern of half cut and full cut incisions which is different from the first herringbone pattern, the rectangular sheet of material capable of collapsing into an elongated shaped parcel by way of the first and second herringbone patterns of half cut and full cut incisions; and a shipping sleeve defining a cross-sectional shape sized to be capable of sliding over the collapsed shipping box and to securely hold the shipping box in the collapsed shape.

20. The reusable shipping box system of claim 19, wherein the elongated parcel includes a parallelogram shape.

21. The reusable shipping box system of claim 20, wherein the shipping box is capable of being constructed into a parcel box for shipping items therein.

22. The reusable shipping box system of claim 19, wherein the rectangular sheet is capable of being folded to create a dual sheet.

* * * * *